US006370868B1

(12) United States Patent
Kolmanovsky et al.

(10) Patent No.: US 6,370,868 B1
(45) Date of Patent: Apr. 16, 2002

(54) METHOD AND SYSTEM FOR PURGE CYCLE MANAGEMENT OF A LEAN $NO_X$ TRAP

(75) Inventors: Ilya Vladimir Kolmanovsky, Ypsilanti; Jing Sun, Bloomfield, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/542,784

(22) Filed: Apr. 4, 2000

(51) Int. Cl.[7] ..... F01N 3/00
(52) U.S. Cl. ..... 60/274; 60/276; 60/285
(58) Field of Search ..... 60/274, 276, 285, 60/286; 123/673, 674; 701/102–115

(56) References Cited

U.S. PATENT DOCUMENTS

| | | | |
|---|---|---|---|
| 3,969,932 | A | 7/1976 | Rieger et al. |
| 4,622,809 | A | 11/1986 | Abthoff et al. |
| 4,854,123 | A | 8/1989 | Inoue |
| 4,884,066 | A | 11/1989 | Miyata et al. |
| 4,913,122 | A | 4/1990 | Uchida et al. |
| 5,009,210 | A | 4/1991 | Nakagawa et al. |
| 5,088,281 | A | 2/1992 | Izutani et al. |
| 5,174,111 | A | 12/1992 | Nomur et al. |
| 5,189,876 | A | 3/1993 | Hirota et al. |
| 5,201,802 | A | 4/1993 | Hirota et al. |
| 5,233,830 | A | 8/1993 | Takeshima et al. |
| 5,267,439 | A | 12/1993 | Raff et al. |
| 5,270,024 | A | 12/1993 | Kasahara et al. |
| 5,325,664 | A | 7/1994 | Seki et al. |
| 5,331,809 | A | 7/1994 | Takeshima et al. |
| 5,335,538 | A | 8/1994 | Blischke et al. |
| 5,402,641 | A | 4/1995 | Katoh et al. |
| 5,412,945 | A | 5/1995 | Katoh et al. |
| 5,423,181 | A | 6/1995 | Katoh et al. |
| 5,433,074 | A | 7/1995 | Seto et al. |

(List continued on next page.)

FOREIGN PATENT DOCUMENTS

| | | |
|---|---|---|
| DE | 196 07 151 C1 | 7/1997 |
| EP | 0 351 197 A2 | 1/1990 |
| EP | 0 444 783 A1 | 9/1991 |
| EP | 0 503 882 A1 | 9/1992 |
| EP | 0 598 917 A1 | 6/1994 |
| EP | 0 627 548 A1 | 12/1994 |
| EP | 0 713 959 A2 | 5/1996 |
| JP | 62-97630 | 5/1987 |
| JP | 62-117620 | 5/1987 |
| JP | 64-53042 | 3/1989 |
| JP | 2-30915 | 2/1990 |
| JP | 2-33408 | 2/1990 |
| JP | 2-207159 | 8/1990 |
| JP | 3-135417 | 6/1991 |
| JP | 5-26080 | 2/1993 |

(List continued on next page.)

OTHER PUBLICATIONS

"An Air/Fuel Algorithm To Improve The NOx Conversion of Copper–Based Catalysts", by Joe Theis et al, SAE Technical Paper No. 922251, Oct. 19–22, 1992, pp. 77–89.

"Effect of Air–Fuel Ratio Modulation on Conversion Efficiency of Three–Way Catalysts", by Y. Kaneko et al., Inter–Industry Emission Control Program 2 (IIEC–2) Progress Report No. 4, SAE Technical Paper No. 780607, Jun. 5–9, 1978, pp. 119–127.

"Engineered Control Strategies For Improved Catalytic Control of Nox in Lean Burn Applications", by Alan F. Diwell, SAE Technical Paper No. 881595, 1988, pp. 1–11.

*Primary Examiner*—Thomas Denion
*Assistant Examiner*—Tu M. Nguyen
(74) *Attorney, Agent, or Firm*—Allen J. Lippa

(57) ABSTRACT

Purging of a $NO_X$ trap is initiated if the estimated mass of $NO_X$ in the trap exceeds a $NO_X$ mass threshold value unless the estimated probability that the engine will be subjected to high load and high speed conditions exceed a probability threshold value, in which event the decision whether to initiate the purging of said trap is delayed for a predetermined time interval.

18 Claims, 2 Drawing Sheets

U.S. PATENT DOCUMENTS

| | | | | | |
|---|---|---|---|---|---|
| 5,437,153 | A | | 8/1995 | Takeshima et al. | |
| 5,448,887 | A | | 9/1995 | Takeshima | |
| 5,450,722 | A | | 9/1995 | Takeshima et al. | |
| 5,467,755 | A | * | 11/1995 | Konrad et al. | 123/674 |
| 5,472,673 | A | | 12/1995 | Goto et al. | |
| 5,473,887 | A | | 12/1995 | Takeshima et al. | |
| 5,473,890 | A | | 12/1995 | Takeshima et al. | |
| 5,483,795 | A | | 1/1996 | Katoh et al. | |
| 5,544,482 | A | | 8/1996 | Matsumoto et al. | |
| 5,577,382 | A | | 11/1996 | Kihara et al. | |
| 5,595,060 | A | | 1/1997 | Togai et al. | |
| 5,651,353 | A | * | 7/1997 | Allston | 123/673 |
| 5,693,877 | A | | 12/1997 | Ohsuga et al. | |
| 5,711,149 | A | * | 1/1998 | Araki | 60/286 |
| 5,713,199 | A | | 2/1998 | Takeshima et al. | |
| 5,715,679 | A | | 2/1998 | Asanuma et al. | |
| 5,735,119 | A | | 4/1998 | Asanuma et al. | |
| 5,740,669 | A | * | 4/1998 | Kinugasa et al. | 60/285 |
| 5,743,084 | A | | 4/1998 | Hepburn | |
| 5,746,049 | A | | 5/1998 | Cullen et al. | |
| 5,758,493 | A | | 6/1998 | Asik et al. | |
| 5,822,979 | A | | 10/1998 | Hamburg et al. | |
| 5,894,725 | A | | 4/1999 | Cullen et al. | |
| 6,021,638 | A | * | 2/2000 | Hochmuth | 60/274 |
| 6,032,461 | A | * | 3/2000 | Kinugasa et al. | 60/285 |

FOREIGN PATENT DOCUMENTS

| | | |
|---|---|---|
| JP | 6-264787 | 3/1993 |
| JP | 5-106493 | 4/1993 |
| JP | 5-106494 | 4/1993 |
| JP | 6-58139 | 3/1994 |
| JP | 7-97941 | 4/1995 |

* cited by examiner

METHOD AND SYSTEM FOR PURGE CYCLE MANAGEMENT OF A LEAN $NO_X$ TRAP

TECHNICAL FIELD

This invention relates to lean-burn gasoline engine control and, more specifically, to lean $NO_X$ trap (LNT) purge cycle management.

BACKGROUND ART

A LNT is an additional three-way catalyst exhaust after-treatment for lean burn port fuel injected and direct injected gasoline engines. The LNT is purged periodically to release and convert the oxides of nitrogen ($NO_X$) stored in the trap during the preceding lean operation. To accomplish the purge, the engine has to be operated at an air-to-fuel ratio that is rich of stoichiometry. As a result of the rich operation, substantial amounts of feedgas carbon monoxide (CO) and hydrocarbons (HC) are generated to convert the stored $NO_X$. Typically, the purge mode is activated on the basis of estimated trap loading. That is, when the estimated mass of $NO_X$ stored in the trap exceeds a predetermined threshold, a transition to the purge mode is initiated. The rich operation continues for several seconds until the trap is emptied of the stored $NO_X$, whereupon the purge mode is terminated and the normal lean operation is resumed. The end of the purge is usually initiated by a transition in the reading of the HEGO sensor located downstream of the trap, or based on the model prediction of the LNT states. Since the engine is operated rich of stoichiometry during the purge operation, the fuel economy advantage of the lean operation is lost.

DISCLOSURE OF INVENTION

In accordance with the present invention, the transition to the purge mode is delayed if it is expected that in the near term the engine will be subjected to high load and high speed conditions. Since the lean operation is limited (or is primarily beneficial) to low loads and low engine speeds, the transition to the purge mode may be advantageously delayed if it is expected that during the next few seconds of the ensuing operation, the engine will be subjected to high load and high speed conditions. Thus, by delaying the purge, fuel economy improvements can be attained without a detectable loss in emission performance.

BRIEF DESCRIPTION OF DRAWINGS

A more complete understanding of the present invention may be had from the following detailed description which should be read in conjunction with the drawings in which.

BEST MODE FOR CARRYING OUT THE INVENTION

Figure 1:
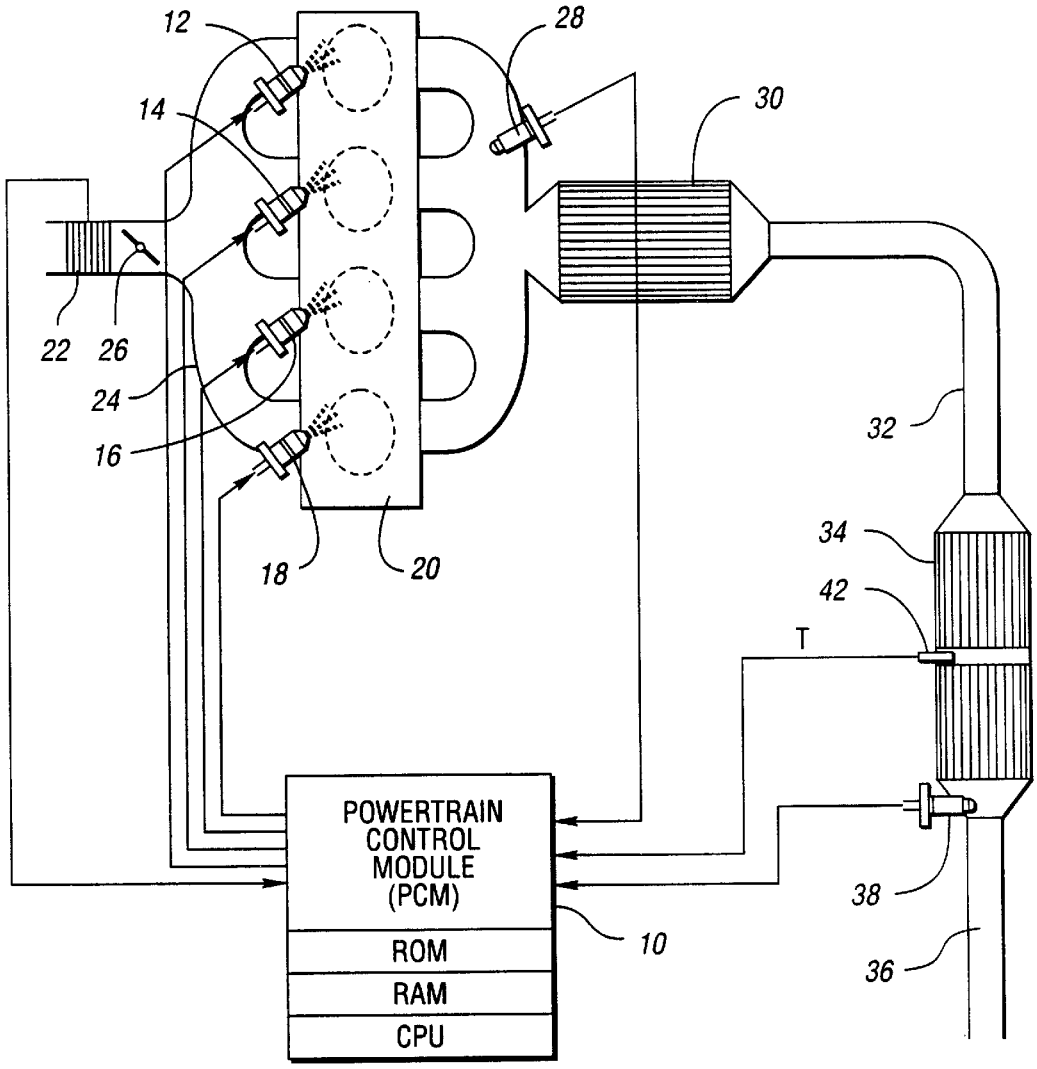
FIG. 1 is block diagram of the system of the present invention.

Referring now to the drawing and initially to FIG. 1, a block diagram of the control system of the present invention is shown. The system comprises an electronic engine controller generally designated 10 that includes ROM, RAM and CPU as indicated. The controller 10 controls a set of injectors 12, 14, 16 and 18 which inject fuel into the combustion chambers of a 4 cylinder internal combustion engine 20. The fuel injectors are of conventional design and are positioned to inject fuel into their associated cylinder in precise quantities and timing as determined by the controller 10. The controller 10 transmits a fuel injector signal to the injectors to maintain an air/fuel ratio determined by the controller 10. An airmeter or air mass flow sensor 22 is positioned at the air intake of the manifold 24 of the engine and provides a signal regarding air mass flow resulting from positioning of the throttle 26. The air flow signal is utilized by controller 10 to calculate an air mass (AM) value which is indicative of a mass of air flowing into the induction system in lbs./min. A heated exhaust gas oxygen (HEGO) sensor, 28 detects the oxygen content of the exhaust gas generated by the engine, and transmits a signal to the controller 10. Alternatively, the sensor 28 may be a universal exhaust gas oxygen sensor (UEGO). Sensor 28 is used for control of the engine A/F, during stoichiometric operation.

An exhaust system, comprising one or more exhaust pipes, transports exhaust gas produced from combustion of an air/fuel mixture in the engine to a conventional close coupled three way catalytic converter (TWC) 30. The converter 30 contains a catalyst material that chemically alters exhaust gas that is produced by the engine to generate a catalyzed exhaust gas. The catalyzed exhaust gas is fed through an exhaust pipe 32 to a downstream $NO_X$ trap 34 and thence to the atmosphere through a tailpipe 36.

A HEGO sensor 38 is located downstream of the trap 34, and provides a signal to the controller 10 for diagnosis and control according to the present invention. The trap 34 contains a temperature sensor 42 for measuring the midbed temperature T which is provided to the controller 10. Alternatively, the midbed temperature may be estimated using a computer model. Still other sensors, not shown, provide additional information about engine performance to the controller 10, such as crankshaft position, angular velocity, throttle position, air temperature, other oxygen sensors in the exhaust system, etc. The information from these sensors is used by the controller to control engine operation.

Figure 2:
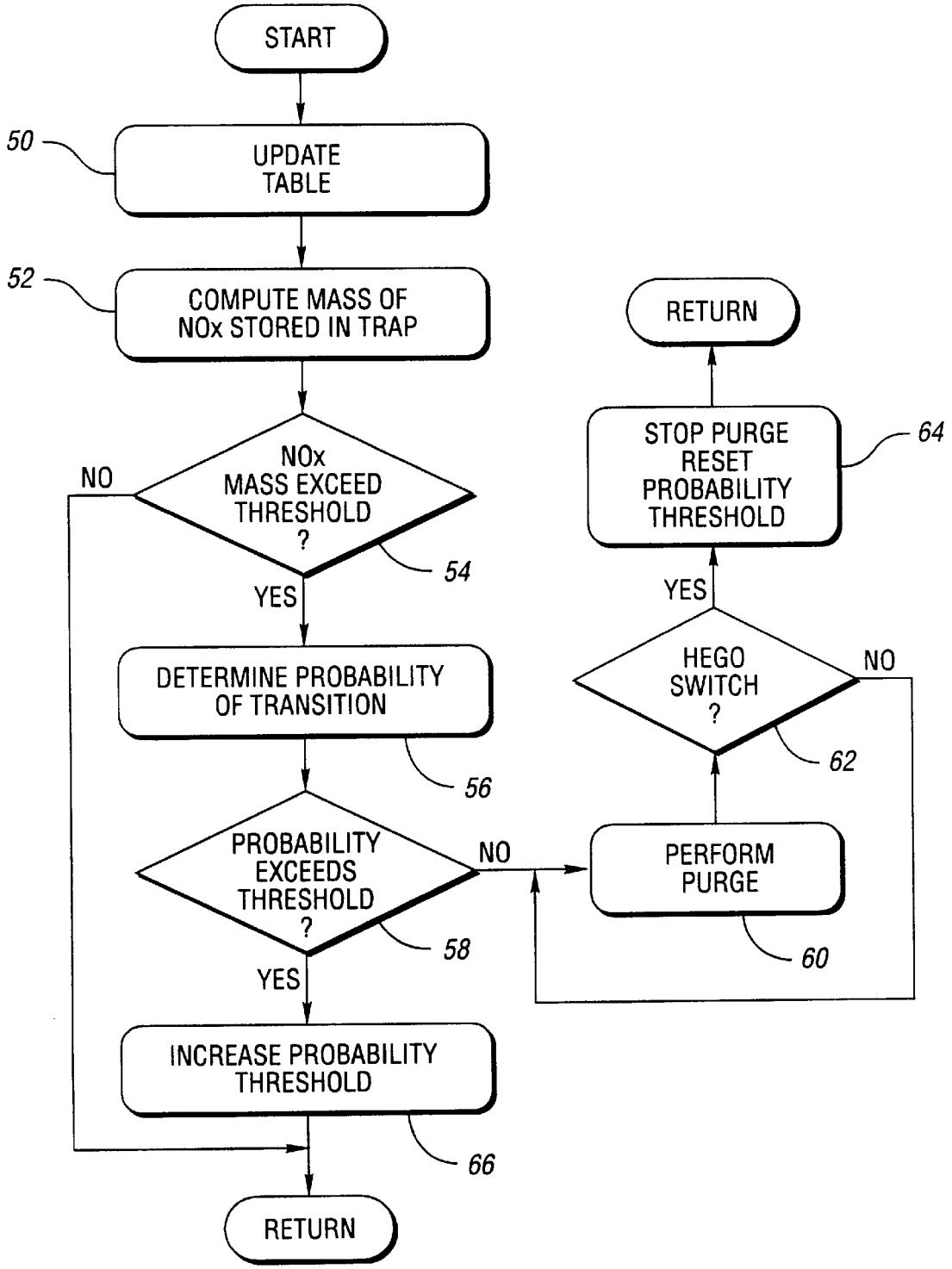
FIG. 2 is a flowchart depicting the method of carrying out the invention.

Referring now to FIG. 2, a flowchart of software subroutine for performing the method of the present invention is shown. This subroutine would be entered periodically from the main engine control software. As indicated at block 50 a probability lookup table is periodically updated based on existing engine operation and at block 52 the estimation of the mass of $NO_X$ stored in the trap is computed. If the mass does not exceed a predetermined threshold as determined in block 54, the subroutine is exited. On the other hand, if the $NO_X$ mass threshold is exceeded, the probability of a transition to a high speed, high load engine operating condition where the engine will operate at stoichiometric or rich of stoichiometric air fuel ratio is determined as indicated at block 56. If that probability does not exceed a calibratable probability threshold as determined in block 58, then the purge of the $NO_X$ trap is begun as shown in the block 60. The purge continues until the HEGO switch indicates that the trap has been purged, as determined in block 62, at which time the purge is terminated and the probability threshold is reset as indicated in block 64 and the subroutine is exited. If the probability threshold is exceeded as determined at block 58, then the purge operation is delayed and the probability threshold is increased by a predetermined amount at block 66 and the subroutine is exited. The next time through the loop, the probability is re-estimated and the decision about delaying the purge is rendered. As the decision cycle proceeds, the probability threshold is raised. Thus, further delaying the purge operation becomes more improbably once the delay process has begun.

The probability table used in block 56 partitions the engine operation into engine speed/engine load cells, Ci, where i=1, . . . , n. Each of the cells, is populated by the probability (Pij) that the engine operating at the present sampling instant in cell Ci will transition in the next sampling instant to a high speed/high load cell Cj.

The probabilities Pi, Pij can be determined from the drive cycle analysis and adapted to current engine behavior based on the past history of engine operation. Specifically, the update of the probability table can be performed as follows. Consider the operation of the engine over a window of time T. If Tij is the number of transitions from any given cell i to any other call j, then Pij can be updated as follows:

$$Pij(new)=\lambda Pij(old)+(1-\lambda)(Tij/Ta)$$

Where λ is a forgetting factor between 0 and 1, Ta is the total number of transitions during the time period T. The probability table is periodically updated in memory as the engine operates and a batch of data of window T is collected.

The probability table may be used in conjunction with other information such as the rate of pedal depression by the driver to predict the probability of high speed/high load conditions in the near term, for example, the next few seconds of engine operation. In that case a second lookup table which maps the pedal depression to the transition probability is stored and used to predict where the engine might be operating in the next few seconds for a given driver input. For example, suppose the driver presses the pedal while the engine is in the cell i. Then the probability of transition to a cell Pnm that corresponds to the same speed value and higher load value is non-zero and is stored in a lookup table indexed by the value of the pedal depression rate. The probability of transition to other cells is zero. The final probability of transition to a high speed and load condition is then obtained by taking the weighted average of Pij and the output of the second lookup table, and the final probability is then used in making the decision whether to delay the purge.

While the best mode for carrying out the present invention has been described in detail, those familiar with the art to which this invention relates will recognize various alternative designs and embodiments for practicing the invention as defined by the following claims.

What is claimed is:

1. A system of controlling the purging of a trap located in the exhaust path of an engine comprising:

means for estimating the mass of $NO_X$ in the trap:

means for estimating the probability that operation of said engine will transition to a high speed high load condition before the expiration of a first predetermined time interval:

means for initiating purging of said trap if the estimated mass of $NO_X$ in the trap exceeds a $NO_X$ mass threshold value unless the estimated probability exceeds a probability threshold value; and means for increasing said probability threshold each time the estimated probability exceeds the probability threshold value.

2. The system of claim 1 including means for resetting the probability threshold each time the purging of said trap is completed.

3. The system of claim 2 wherein said second predetermined interval is the time interval between purge decisions.

4. The system of claim 3 wherein the probability of a transition is dependent on the present engine operating condition and the length of time the engine has been operating at the present condition.

5. The system of claim 1 wherein the probability of transition is obtained from a table of probabilities, said table comprising a plurality of cells each associated with engine speed and engine load operations, each cell containing a first value of the probability of engine operation continuing at the engine speed and engine load associated with the cell and a plurality of second values of the probability of engine operation transitioning from that represented by the present cell to an engine operation represented by each of the other cells in the table.

6. The system of claim 5 wherein said table is continuously updated during engine operation.

7. An article of manufacture comprising:

a storage medium having a computer program encoded therein for causing a microcontroller to control the purging of a trap located in the exhaust path of an engine, said program comprising:

code for estimating the mass of $NO_X$ in the trap;

code for estimating the probability that operation of said engine will transition to a high speed high load condition before the expiration of a first predetermined time interval;

code for initiating purging of said trap if the estimated mass of $NO_X$ in the trap exceeds a $NO_X$ mass threshold value unless the estimated probability exceed a probability threshold value; and code for increasing said probability threshold each time the estimated probability exceed the probability threshold value.

8. The article of claim 7 further including code for resetting the probability threshold each time the purging of said trap is completed.

9. The article of claim 8 wherein said second predetermined interval is the time interval between purge decisions and wherein the probability of a transition is dependent on the present engine operating condition and the length of time the engine has been operating at the present condition.

10. The article of claim 7 wherein the probability of transition is obtained from a table of probabilities, said table comprising a plurality of cells each associated with engine speed and engine load operations, each cell containing a first value of the probability of engine operation continuing at the engine speed and engine load associated with the cell and a plurality of second values of the probability of engine operation transitioning from that represented by the present cell to an engine operation represented by each of the other cells in the table.

11. A method of deciding whether to purge a trap located in the exhaust path of an engine comprising a sequence of the steps of:

estimating the mass of $NO_X$ in the trap;

if the estimated mass of $NO_X$ in the trap exceeds a $NO_X$ mass threshold value then estimating the probability that operation of said engine will transition to a high speed high load condition before the expiration of a first predetermined time interval;

initiating purging of said trap unless the estimated probability exceeds a probability threshold value;

if the estimated probability threshold value is exceeded, delaying the decision of whether to initiate the purging of said trap for a second predetermined time interval; and increasing said probability threshold each time the purging of said trap is delayed so that delaying the purge operation becomes more improbably once the delay process has begun.

12. The method of claim 11 including the additional step of increasing said probability threshold each time the purging of said trap is delayed.

13. The method of claim 11 including the additional step of resetting said probability threshold each time the purging of said trap is completed.

14. The method of claim 13 wherein said second predetermined interval is the time interval between purge decisions.

15. The method of claim 14 wherein the probability of a transition is dependent on the present engine operating condition and the length of time the engine has been operating at the present condition.

16. The method of claim 11 wherein the probability of transition is obtained from a table of probabilities, said table comprising a plurality of cells each associated with engine speed and engine load operations and containing a value of the probability (Pij) of engine operation transitioning from that represented by the present cell Ci to a high speed and high load engine operation cell Cj.

17. The method of claim 16 wherein said table is periodically updated during engine operation in accordance with the following:

$$Pij(new)=\lambda Pij(old)+(1-\lambda)(Tij/Ta)$$

where $\lambda$ is a forgetting factor between 0 and 1;

Tij is the number of transitions from any given cell i to any other cell j;

Ta is the total number of transitions during operation of the engine over a window of time T.

18. The method of claim 17 wherein the probability of transitioning to a high speed and high load engine operating condition is also a function of the rate of pedal depression.

* * * * *